US011013310B2

(12) United States Patent
Hachisuka et al.

(10) Patent No.: US 11,013,310 B2
(45) Date of Patent: May 25, 2021

(54) TOOTHBRUSH AND METHOD FOR MANUFACTURING TOOTHBRUSH

(71) Applicant: Lion Corporation, Tokyo (JP)

(72) Inventors: Ryosuke Hachisuka, Tokyo (JP); Toshiaki Kobayashi, Tokyo (JP)

(73) Assignee: Lion Corporation, Tokyo (JP)

( * ) Notice: Subject to any disclaimer, the term of this patent is extended or adjusted under 35 U.S.C. 154(b) by 0 days.

(21) Appl. No.: 16/344,336

(22) PCT Filed: Oct. 25, 2017

(86) PCT No.: PCT/JP2017/038521
§ 371 (c)(1),
(2) Date: Apr. 23, 2019

(87) PCT Pub. No.: WO2018/079610
PCT Pub. Date: May 3, 2018

(65) Prior Publication Data

US 2019/0274417 A1 Sep. 12, 2019

(30) Foreign Application Priority Data

Oct. 28, 2016 (JP) ..... JP2016-211233

(51) Int. Cl.
*A46B 5/00* (2006.01)
*A46B 5/02* (2006.01)
(Continued)

(52) U.S. Cl.
CPC ..... *A46B 5/0037* (2013.01); *A46B 3/02* (2013.01); *A46B 5/00* (2013.01); *A46B 5/023* (2013.01);
(Continued)

(58) Field of Classification Search
CPC ..... A46B 2200/1066; A46B 3/02; A46B 5/00; A46B 5/0029; A46B 5/0033;
(Continued)

(56) References Cited

U.S. PATENT DOCUMENTS 1,796,001 A * 3/1931 Church ..... A46B 5/0025 15/167.1
5,630,244 A * 5/1997 Chang ..... A46B 5/0062 15/143.1
(Continued)

FOREIGN PATENT DOCUMENTS

CN 101909483 A 12/2010
CN 203137434 U 8/2013
(Continued)

OTHER PUBLICATIONS

WO-2015050019-A1—English Machine Translation (Year: 2015).*
(Continued)

*Primary Examiner* — Marc Carlson
(74) *Attorney, Agent, or Firm* — Kolisch Hartwell, P.C.

(57) ABSTRACT

A toothbrush capable of inhibiting damage of an oral cavity of a user that includes: a head section that has a bristle implanting surface on a front end side; a handle section that is disposed on a rear end side from the head section and has a handle section main body; and a neck section that is disposed between the bristle implanting surface and the handle section. The toothbrush has a deforming portion that is located on the rear end side from the bristle implanting surface and is deformed, while stress characteristics associated with bending due to an external force acting on the head section are in a plane stress condition.

9 Claims, 9 Drawing Sheets

(51) Int. Cl.
*A46B 3/02* (2006.01)
*A46B 5/06* (2006.01)

(52) U.S. Cl.
CPC ..... *A46B 5/06* (2013.01); *A46B 2200/1066* (2013.01)

(58) Field of Classification Search
CPC ... A46B 5/0037; A46B 5/0062; A46B 5/0066; A46B 5/023; A46B 5/06
See application file for complete search history.

(56) References Cited

U.S. PATENT DOCUMENTS

| | | | | |
|---|---|---|---|---|
| 2016/0088929 | A1* | 3/2016 | Lee | A46B 15/0012 15/167.1 |
| 2017/0280864 | A1* | 10/2017 | Lolling | A46B 9/025 |
| 2018/0303231 | A1* | 10/2018 | Jimenez | A46B 9/06 |

FOREIGN PATENT DOCUMENTS

| | | | | |
|---|---|---|---|---|
| CN | 103442614 | A | 12/2013 | |
| CN | 103763982 | A | 4/2014 | |
| DE | 9113769 | U1 | 1/1992 | |
| DE | 202006011720 | U1 | 1/2008 | |
| DE | 102009011836 | A1 | 9/2010 | |
| JP | 01141630 | U | 9/1989 | |
| JP | 02079825 | U | 6/1990 | |
| JP | 2003025376 | A | 1/2003 | |
| JP | 2006000466 | A | 1/2006 | |
| JP | 2013000458 | A | 1/2013 | |
| JP | 2013118944 | A | 6/2013 | |
| JP | 2016016069 | A | 2/2016 | |
| JP | 2016034309 | A | 3/2016 | |
| JP | 6591988 | B2 | 9/2019 | |
| WO | 9119438 | A1 | 12/1991 | |
| WO | 2014018323 | A1 | 1/2014 | |
| WO | WO-2015050019 | A1 * | 4/2015 | A46B 9/04 |
| WO | 2015137180 | A1 | 9/2015 | |
| WO | WO-2016035678 | A1 * | 3/2016 | A46B 5/00 |

OTHER PUBLICATIONS

State Intellectual Property Office of People's Republic of China, "First Notice of Opinion on Examination" in connection with related Chinese Application No. 201580046958.7, dated Feb. 14, 2018, 19 pgs.

State Intellectual Property Office of People's Republic of China, "Second Notice of Opinion on Examination" in connection with related Chinese Application No. 201580046958.7, dated Oct. 25, 2018, 16 pgs.

Japanese Patent Office, Notification (information statement) in connection with related Japanese Application No. 2016-0546601, dated Apr. 11, 2018, 27 pgs.

Japanese Patent Office, "Notice of Reasons for Rejection" in connection with related Japanese Application No. 2016-546601, dated Feb. 19, 2019, 8 pgs.

State Intellectual Property Office of People's Republic of China, "Final Rejection" in connection with related Chinese Application No. 201580046958.7, dated May 28, 2019, 14 pgs.

Japanese Patent Office, "Interational Search Report" in connection with related International Application No. PCT/JP2017/038521, dated Dec. 26, 2017, 4 pgs.

Chinese Patent Office, Search Report in Chinese Patent Application No. 201780066420.1, dated Apr. 3, 2020, 9 pages.

European Patent Office, Extended European Search Report in European Patent Application No. 17863466.3, dated Apr. 21, 2020, 9 pages.

* cited by examiner

TOOTHBRUSH AND METHOD FOR MANUFACTURING TOOTHBRUSH

TECHNICAL FIELD

The present invention relates to a toothbrush and a method for manufacturing the toothbrush.

Priority is claimed on Japanese Patent Application No. 2016-211233, filed on Oct. 28, 2016, the content of which is incorporated herein by reference.

BACKGROUND ART

In the related art, when a user falls during brushing teeth with a toothbrush (specifically, in a state of holding the toothbrush in the mouth), the user suffers an extraoral bruise, in some cases. In particular, in a case where the user of the toothbrush is a one- to three-year-old infant, the user suffers the extraoral bruise, in many cases.

In the related art, as a toothbrush with which it is possible to inhibit a head section and a neck section from being damaged or broken, a toothbrush is disclosed in Patent Document 1.

Patent Document 1 discloses the toothbrush provided with a coating layer on a front surface of a base configured of a hard resin, the coating layer made of a soft resin that covers 70% or larger of a total area of a surface area of the head section and a surface area of the neck section.

Patent Document 1 discloses that, in such a configuration described above, it is possible for a handle body not to be easily broken even in a case where a very large load is applied to the head section or the neck section, or it is possible for the coating layer to inhibit a broken zone from being exposed even in a case where the head section or the neck section is broken. In the toothbrush disclosed in Patent Document 1, which has the configuration, the base that configures a front end portion of the head section is covered with the soft resin, and thus the soft resin functions as a cushion member when the head section is strongly bitten, or a front end of the head section strongly collides with a portion inside an oral cavity.

Therefore, a use of the toothbrush disclosed in Patent Document 1 enables the inside of the oral cavity from being damaged due to the front end portion of the head of the toothbrush.

In addition, Patent Document 2 discloses a toothbrush in which, in a case where a predetermined compressive force is applied to the toothbrush in a longitudinal direction of a handle section, bending occurs to a connecting section due to plastic deformation, and a bristle implanting surface of a head section is positioned on an inner side of the bending. With the toothbrush disclosed in Patent Document 2, an entering amount of the handle section into the oral cavity is further restricted, and thereby improvement in safety is achieved.

CITATION LIST

Patent Literature

[Patent Document 1] Japanese Unexamined Patent Application, First Publication No. 2013-458

[Patent Document 2] Japanese Unexamined Patent Application, First Publication No. 2016-034309

SUMMARY OF INVENTION

Technical Problem

However, the neck section of the toothbrush disclosed in Patent Document 1 is provided with the coating layer made of the soft resin, which has a thickness thinner than that of the base, so as to cover the front surface of the base that configures the neck section. Therefore, when an external force is applied to the toothbrush in an extending direction of the toothbrush (specifically, a direction from a rear end toward a front end of the toothbrush), for example, the head section of the toothbrush disclosed in Patent Document 1 is difficult to bend so as to avoid damaging the inside of the oral cavity of the user and to sufficiently avoid the external force that is transmitted to the front end of the head section.

In addition, the toothbrush disclosed in Patent Document 2 has the plastically deformed connecting section that remains as a stiff body inside the oral cavity even when the entering amount of the handle section into the inside of the oral cavity is restricted. Hence, from a viewpoint of avoiding damage of the oral cavity of the user, the toothbrush is not evaluated to ensure sufficient safety.

The present invention is made with consideration for such problems, and an object thereof is to provide a toothbrush and a method for manufacturing the toothbrush with which it is possible to inhibit damage of an oral cavity of a user.

Solution to Problem

According to a first aspect of the present invention, there is provided a toothbrush including: a head section that has a bristle implanting surface on a front end side; a handle section that is disposed on a rear end side from the head section and has a handle section main body; a neck section that is disposed between the bristle implanting surface and the handle section; and a deforming portion that is disposed on the rear end side from the bristle implanting surface and is deformed, while stress characteristics associated with bending due to an external force acting on the head section are in a plane stress condition.

In addition, in the toothbrush according to the aspect of the present invention, the deforming portion is deformed, while exhibiting a plane stress condition regarding bending in parallel with the bristle implanting surface and in a direction orthogonal to a longitudinal direction of the handle section.

In addition, the toothbrush according to the aspect of the present invention further includes a hard member that is disposed over a region from the head section to a part of the handle section on a front end side and is formed of a hard resin; and a soft portion that accommodates at least a part of the hard member inside and is formed of a soft resin. The deforming portion is disposed in at least a part of the region in which the hard member is disposed.

In addition, in the toothbrush according to the aspect of the present invention, the hard member in the deforming portion has a thickness of 0.5 mm or thicker and 2 mm or thinner in the bending direction and a flexural modulus of 500 MPa or higher.

In addition, in the toothbrush according to the aspect of the present invention, when D represents the thickness of the hard member in the deforming portion in the bending direction, and L represents a longest sectional length in a section of the hard member in the deforming portion, the section being orthogonal to a length direction of the handle section, a relationship of $D \times \sqrt{2} \leq L$ is satisfied.

In addition, in the toothbrush according to the aspect of the present invention, the hard member in the deforming portion has second moment of area of 0.05 $mm^4$ or larger and 5.8 $mm^4$ or smaller in the bending direction.

In addition, in the toothbrush according to the aspect of the present invention, the hard member in the deforming portion has a sectional shape of a square, a rectangle, a polygon, or an ellipse.

In addition, in the toothbrush according to the aspect of the present invention, the hard resin is polypropylene.

According to a second aspect of the present invention, there is provided a method for manufacturing a toothbrush, including: a step of designing a toothbrush including a head section that has a bristle implanting surface on a front end side, a handle section that is disposed on a rear end side from the head section and has a handle section main body, and a neck section that is disposed between the bristle implanting surface and the handle section; and a step of molding the designed toothbrush. The step of designing the toothbrush includes designing that a deforming portion is disposed on the rear end side from the bristle implanting surface, the deforming portion being deformed, while stress characteristics associated with bending due to an external force acting on the head section are in a plane stress condition.

Advantageous Effects of Invention

In the present invention, it is possible to inhibit damage of an oral cavity of a user.

DESCRIPTION OF EMBODIMENTS

Hereinafter, embodiments of a toothbrush and a method for manufacturing the toothbrush of the present invention will be described with reference to FIGS. 1 to 14.

An embodiment to be described below represents an aspect of the present invention does not limit the present invention thereto, and it is possible to perform any modification within the range of the technical idea of the present invention. In addition, in the following drawings, in order to show each configuration in an easily understandable manner, a scale, the number of components, or the like in each structure is different from that of an actual structure. Here, for example, an example is described, in which a hard resin and a soft resin are both used, or a neck section having a width equal to or narrower than the maximum width of a head section is disposed between the head section and a handle section.

Figure 1:
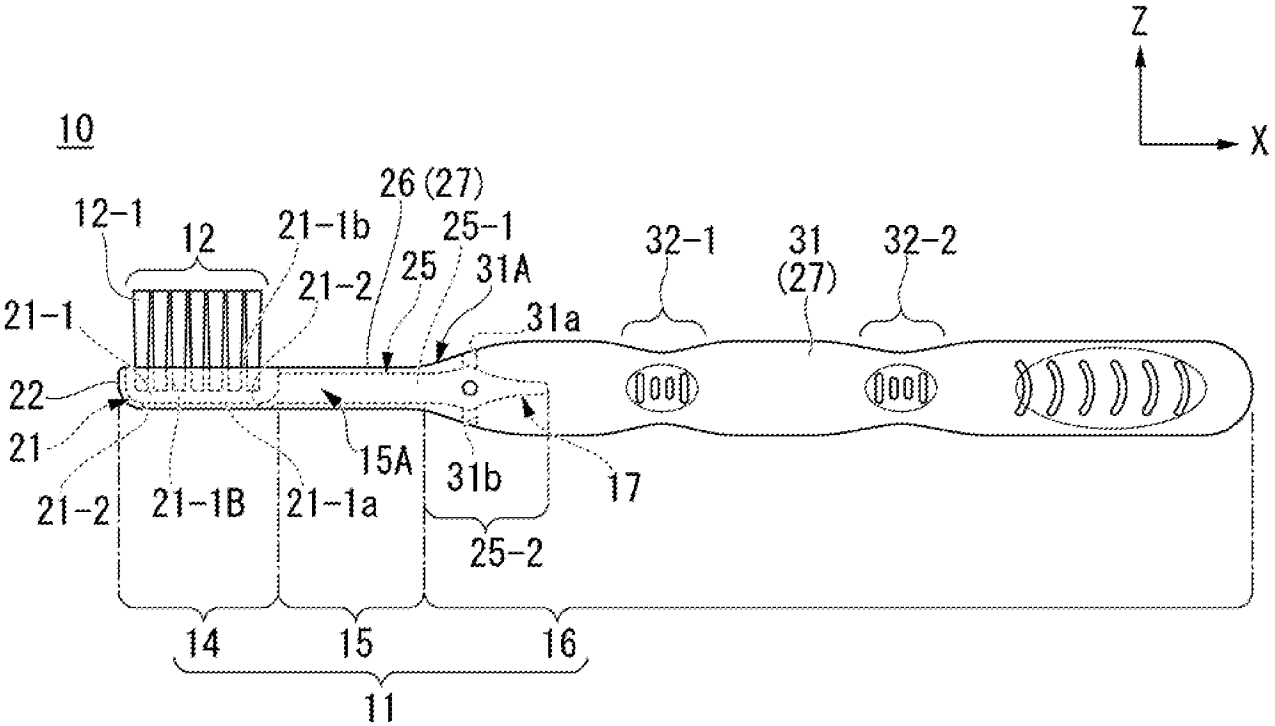
FIG. 1 is a side view of a toothbrush according to an embodiment of the present invention.
Figure 2:
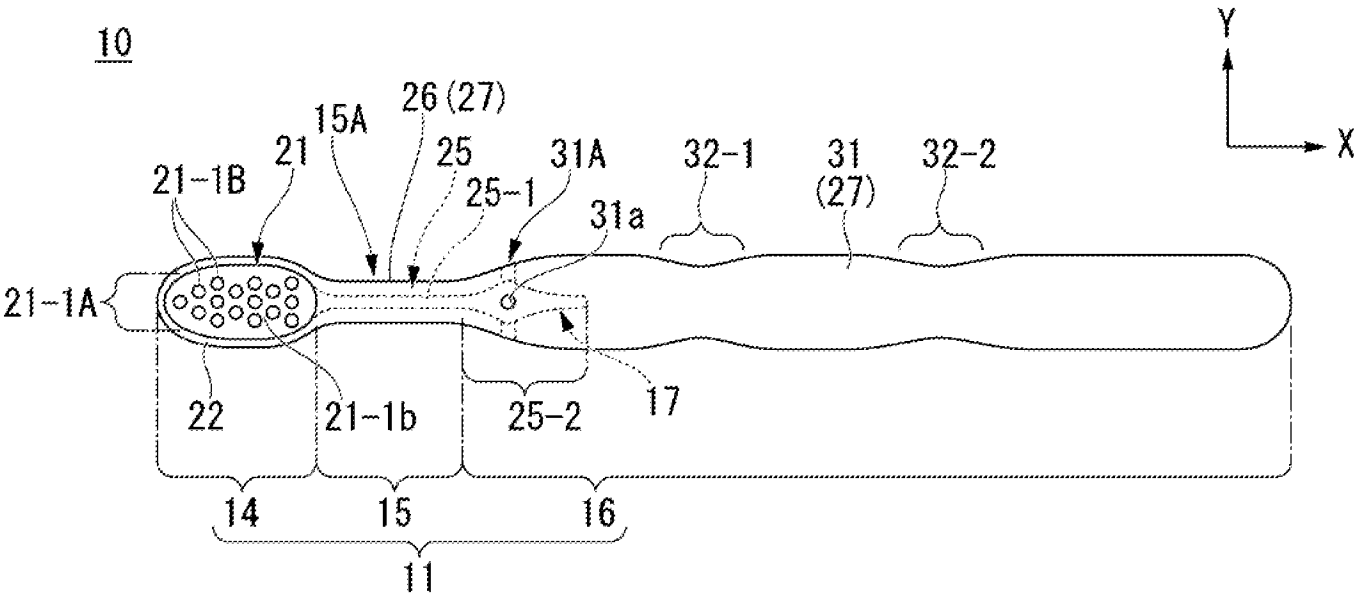
FIG. 2 is a front view of the toothbrush shown in FIG. 1.
Figure 3:
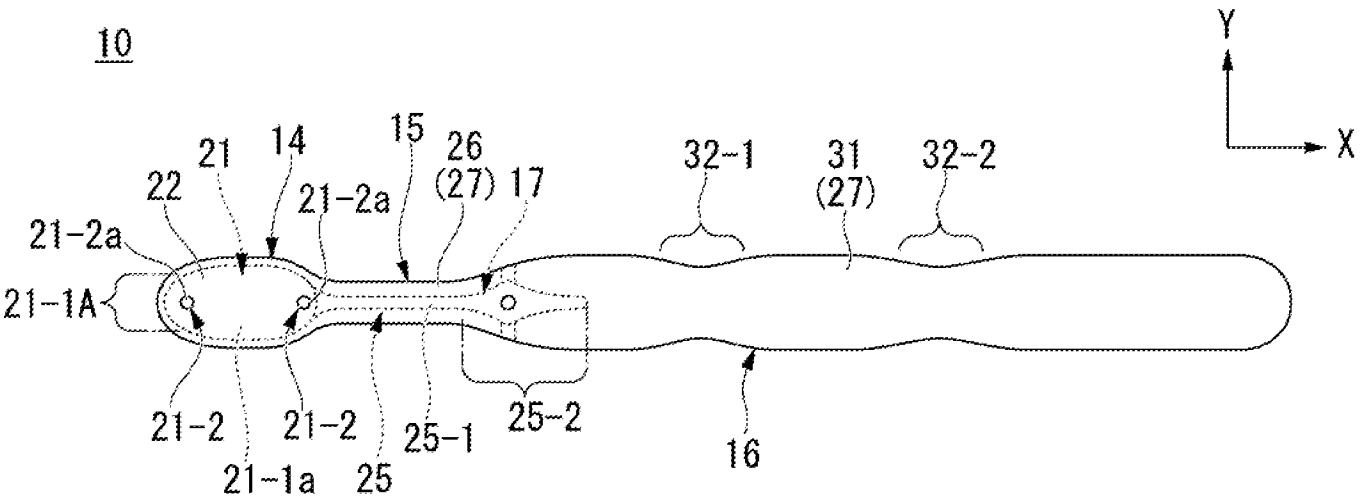
FIG. 3 is a back view of the toothbrush shown in FIG. 1.

FIG. 1 is a side view of a toothbrush 10 according to an embodiment of the present invention. FIG. 2 is a front view of the toothbrush shown in FIG. 1. In FIG. 2, a brush section 12 configured of a plurality of bristle bundles 12-1 shown in FIG. 1 is omitted, for convenience of description. FIG. 3 is a back view of the toothbrush shown in FIG. 1.

Figure 4:
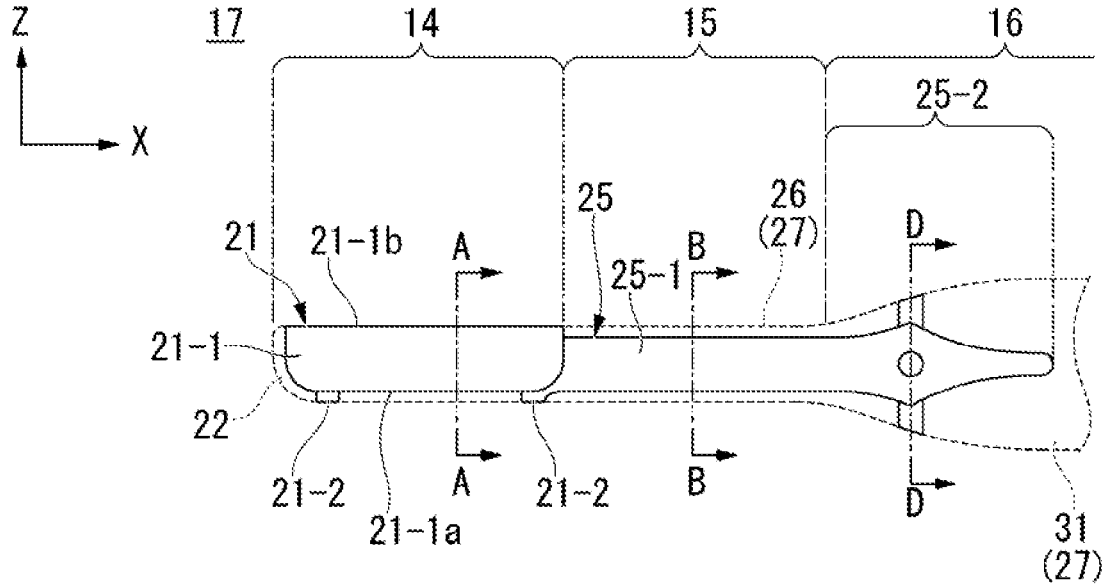
FIG. 4 is an enlarged side view of a hard member shown in FIG. 1.
Figure 5:
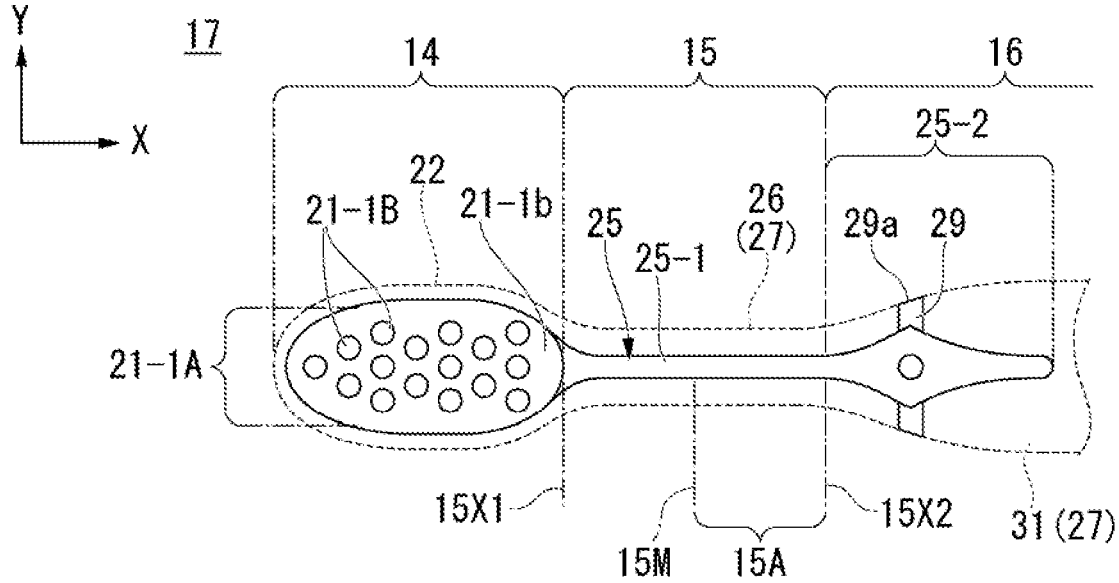
FIG. 5 is an enlarged front view of the hard member shown in FIG. 2.
Figure 6:
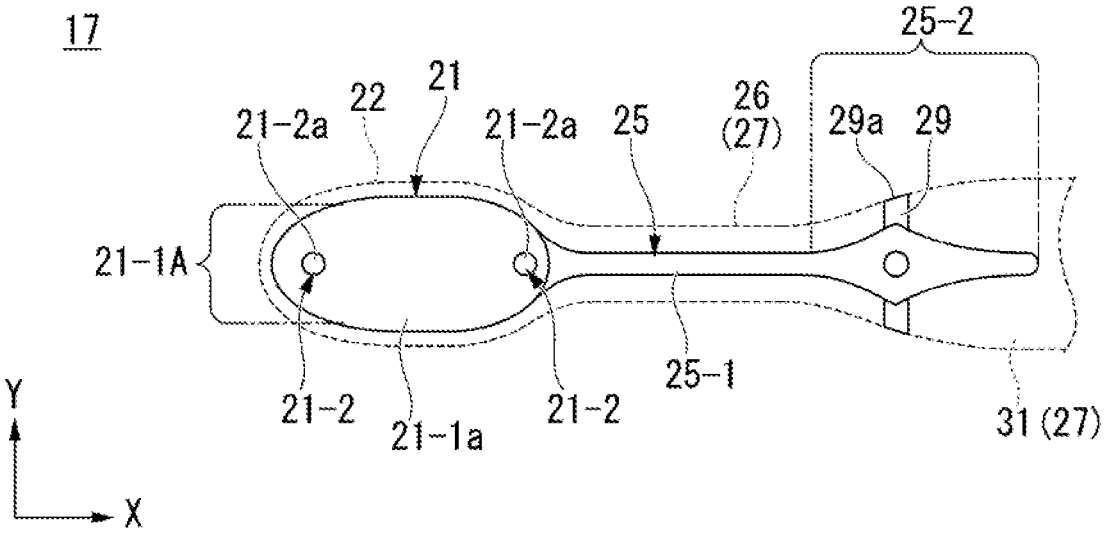
FIG. 6 is an enlarged back view of the hard member shown in FIG. 3.

FIG. 4 is an enlarged side view of a hard member shown in FIG. 1. FIG. 5 is an enlarged front view of the hard member shown in FIG. 2. FIG. 6 is an enlarged back view of the hard member shown in FIG. 3.

In a structure shown in FIGS. 1 to 6, the same reference signs are assigned to the same configurational parts. An X direction shown in FIGS. 1 to 6 represents an extending direction of a handle body 11 (an extending direction of a neck section 15) in a state in which the toothbrush 10 is not used. A Z direction shown in FIGS. 1 and 4 represents a direction (normal direction) orthogonal to a bristle implanting surface 21-1*b* in a state in which the toothbrush 10 is not used. A Y direction shown in FIGS. 2, 3, 5 and 6 represents a width direction (direction orthogonal to the Z direction and the X direction) of the toothbrush 10.

The toothbrush 10 includes the handle body 11 and the brush section 12. The handle body 11 includes a head section 14, the neck section 15, a handle section 16, and a hard member 17 that configures a part of the head section 14, the neck section 15, and the handle section 16. In the embodiment, the toothbrush 10 is described, in which the neck section 15 is disposed between the bristle implanting surface 21-1*b* and the handle section 16, the neck section having a width in the Y direction which is narrower than a width (maximum width in the Y direction) of the head section 14.

The head section 14 has a base member 21 configured of the hard resin and a first soft resin 22 that covers a part of the base member 21. The base member 21 is a part of a configurational element of the hard member 17 configured of the hard resin and has a base member main body 21-1 and two support portions 21-2. The base member main body 21-1 has a shape obtained by reducing an external shape of the head section 14 by about 1 to 2 mm such that it is possible to dispose the first soft resin 22 on a side surface and a bottom surface 21-1*a* of the base member main body 21-1. The base member main body 21-1 is provided with a front end portion 21-1A, the bottom surface 21-1*a*, the bristle implanting surface 21-1*b*, and a bristle implanting hole 21-1B.

The front end portion 21-1A is a part of the base member main body 21-1 and is positioned on an opposite side of a side on which the head section 14 is connected to the neck section 15. The front end portion 21-1A is a portion facing an inside of the oral cavity of a user when the user brushes teeth by using the toothbrush 10. The front end portion 21-1A may have a roundish shape (round shape), for example.

Figure 7:
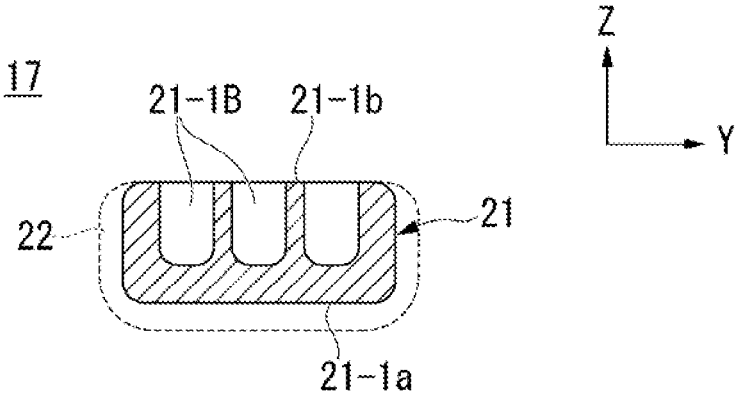
FIG. 7 is a sectional view in a line A-A direction of the hard member shown in FIG. 4.

FIG. 7 is a sectional view in a line A-A direction of the hard member 17 shown in FIG. 4. The bottom surface 21-1*a* of the hard member 17 is a part that is covered with the first soft resin 22 and is disposed on an opposite side of the bristle implanting surface 21-1*b*. The bottom surface 21-1*a* can be a flat surface, for example.

The bristle implanting surface 21-1*b* is formed of a flat surface. The bristle implanting surface 21-1*b* exposes a plurality of bristle implanting holes 21-1B. The bristle implanting surface 21-1*b* is a first exposed portion in the head section 14 and is exposed from the first soft resin 22. In this manner, the base member main body 21-1 is configured of using the hard resin harder than the first soft resin 22, and the plurality of bristle implanting holes 21-1B and the bristle implanting surface 21-1*b* are exposed from the first soft resin 22. Consequently, it is possible to implant (perform implantation of) the bristle bundles 12-1 into the plurality of bristle implanting holes 21-1B by using a flat implantation method, the bristle bundle configuring the brush section 12.

Figure 12:
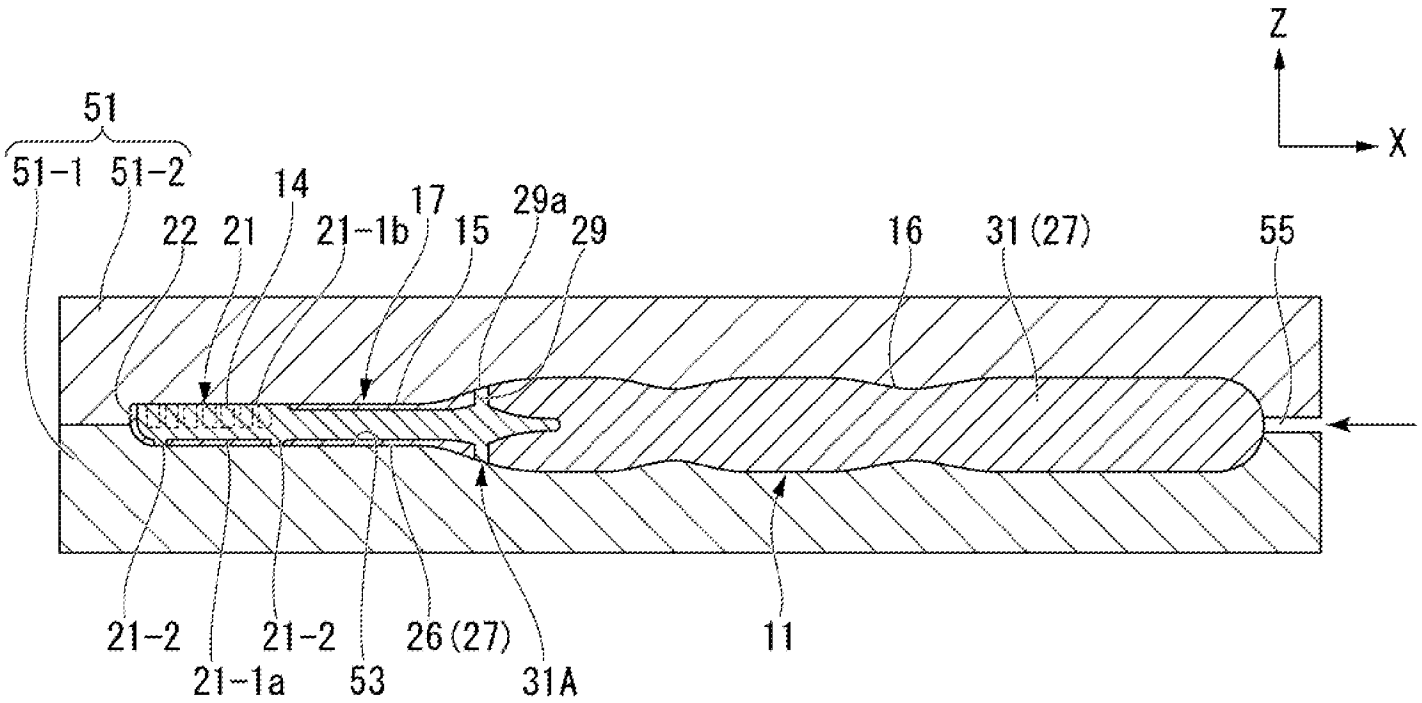
FIG. 12 is a sectional view showing a step of manufacturing the toothbrush of the embodiment and shows a view showing a step of forming a first soft resin, a soft portion, and a handle section main body by using a second die.

The bristle implanting surface 21-1*b* is a surface that is brought into contact with an inner surface of one die 51-2 (refer to FIG. 12) when the first soft resin 22, a soft portion 26, and a handle section main body 31 are molded with a resin, by using a second die 51 shown in FIG. 12 to be described below. In this manner, the bristle implanting surface 21-1*b* is brought into contact with the inner surface of the die 51-2 that configures the second die 51, and thereby it is possible to inhibit the first soft resin 22 from being formed on the plurality of bristle implanting holes 21-1B and the bristle implanting surface 21-1*b*.

The plurality of bristle implanting holes 21-1B are provided in the base member main body 21-1 on a side on which the bristle implanting surface 21-1*b* is configured. The bristle implanting holes 21-1B are holes into which the bristle bundles 12-1 that configure the brush section 12 are implanted. For example, it is possible to arrange the plurality of bristle implanting holes 21-1B as shown in FIG. 2; however, arrangement of the holes is not limited thereto, and any arrangement pattern such as a so-called grid arrangement or zigzag arrangement pattern may be used. In addition, the number of the plurality of bristle implanting holes 21-1B is not limited to the number of bristle implanting holes 21-1B shown in FIG. 2, and it is possible to appropriately set the number of holes to be within a range of 10 to 60 holes, for example. In other words, it is possible to appropriately set the arrangement of the plurality of bristle implanting holes 21-1B and the number of bristle implanting holes 21-1B depending on a purpose. A shape of the bristle implanting hole 21-1B is not particularly limited, and it is possible to employ a polygonal shape or the like such as an exactly circular shape, a circular shape such as an ellipse, a triangular shape, or a quadrangular shape, for example. In addition, it is possible to determine a diameter of the bristle implanting hole 21-1B depending on the size of the bristle bundle 12-1. Specifically, it is possible to appropriately set the diameter to be within a range of 1 to 3 mm, for example.

In a case where the head section 14 has a thickness of 5.0 mm in the Z direction, the base member main body 21-1 can have a thickness (in other words, a thickness between the bottom surface 21-1*a* and the bristle implanting surface 21-1*b*) of 4.2 mm in the Z direction, for example. In this case, a depth of the plurality of bristle implanting holes 21-1B can be 2.5 mm with the bristle implanting surface 21-1*b* as a reference, for example. The thickness of the head section 14 is a thickness measured in a central part in the head section 14 in the X direction, as an example.

The two support portions 21-2 are provided to project from the bottom surface 21-1*a* of the base member main body 21-1 in the Z direction (in a case of a state shown in FIG. 1, downward). One of the two support portions 21-2 is disposed on a front end side of the base member main body 21-1 and the other support portion is disposed on a rear end side of the base member main body 21-1. The two support portions 21-2 are disposed to face each other in the X direction. The two support portions 21-2 are each provided with a projecting surface 21-2*a* configured of a flat surface. The two projecting surfaces 21-2*a* are exposed from an outer surface of the first soft resin 22 and are flush with the outer surface of the first soft resin 22. In other words, the support portion 21-2 is a second exposed portion in the head section 14 and is posed on a side opposite to the bristle implanting surface 21-1*b* as shown in FIG. 3.

The projecting surface 21-2*a* is a part that is brought into contact with an inner surface of a first die 41 shown in FIG. 11 to be described below, when the hard member 17 including the base member main body 21-1 is molded by using the first die 41 (refer to FIG. 11). In this manner, the projecting surfaces 21-2*a* are brought into contact with the inner surface of the first die 41 (refer to FIG. 11), and thereby it is possible to form the first soft resin 22 on the periphery of the two support portions 21-2 and the bottom surface 21-1*a*.

The base member 21 configured as described above is configured to have a rear end that is integrated with an end portion of a core portion 25 on the front end side. As the hard resin that configures the base member 21, a resin harder than the first soft resin 22 is used. Specifically, as the hard resin that configures the base member main body 21-1, it is possible to use a resin having a flexural modulus (JIS 7171) within a range of 500 to 3,000 MPa, with consideration for securing a strength during brushing, for example. Within the range, it is possible to achieve both operability during insertion of the toothbrush into the oral cavity and securing of the plane stress condition of the deforming portion 15A.

Specific examples of the hard resin can include polypropylene (PP), polyethylene terephthalate (PET), polybutylene terephthalate (PBT), polycyclohexylenedimethylene terephthalate (PCT), polyacetal (POM), polystyrene (PS), acrylonitrile butadiene styrene resin (ABS), cellulose propionate (CP), polyarylate, polycarbonate, or acrylonitrile styrene copolymer resin (AS). The hard resin may be used alone or a combination of two or more kinds thereof may be used.

The first soft resin 22 is provided to cover the side surface and the bottom surface 21-1*a* of the base member main body 21-1 in a state of exposing the bristle implanting surface 21-1*b*, the plurality of bristle implanting holes 21-1B, and end surfaces 21-2*a* of the two support portions 21-2. Consequently, the first soft resin 22 is disposed to cover the front end portion 21-1A of the base member main body 21-1.

In this manner, the first soft resin 22 is disposed to cover the front end portion 21-1A of the base member main body 21-1, and thereby the first soft resin 22 disposed on the front end portion 21-1A functions as a cushion when the user uses the toothbrush 10. Hence, when an external force is applied in a direction from the rear end side toward the front end side of the toothbrush 10, and the first soft resin 22 disposed on the front end portion 21-1A is strongly pressed into the oral cavity of the user, it is possible to inhibit damage of the oral cavity of the user.

It is possible to appropriately set a thickness of the first soft resin 22 disposed on the side surface and the bottom surface 21-1*a* of the base member main body 21-1 to be within a range of 0.2 to 2.0 mm, for example, depending on a purpose, and it is possible to set the thickness to 0.8 mm, for example.

FIGS. 1 to 3 shows an example of a case where the first soft resin 22 is provided to cover the side surface and the bottom surface 21-1*a* of the base member main body 21-1; however, the first soft resin 22 may be disposed to cover at least the front end portion 21-1A of the base member main body 21-1.

For example, as the first soft resin 22, it is possible to use a soft resin of which a hardness of JIS K 7215 Shore A is 90 or lower. Examples of the soft resin can include elastomer resin such as polyolefin-based elastomer, styrene-based elastomer, or polyester-based elastomer, and it is preferable to use styrene-based elastomer of the elastomers in terms of adhesiveness with polypropylene (PP). Specific examples of styrene-based elastomer can include Septon (trade name) manufactured by Kuraray Co., Ltd., Leostomer (trade name) manufactured by RIKEN TECHNOS Corporation, or the like.

In addition, the first soft resin 22 may be appropriately selected depending on a type of hard resin that configures the base member 21. Specifically, in a case where polypropylene (PP) is used as the hard resin that configures the base member 21, it is preferable to use polyolefin-based elastomer or styrene-based elastomer as the first soft resin 22, for example, and it is more preferable to use styrene-based elastomer. A combination of the hard resin that configures the base member 21 and the first soft resin 22 is the combination described above, and thereby it is possible to sufficiently secure adhesiveness between the base member 21 and the first soft resin 22.

The length (length in the X direction) of the head section 14 configured as described above is not particularly limited, and the length is preferably within a range of 10 to 30 mm and, more preferably, within a range of 12 to 28 mm, for example. When the length of the head section 14 is 10 mm or longer, it is possible to sufficiently secure an area of the bristle implanting surface 21-1*b* into which the bristle bundles 12-1 can be implanted. In addition, when the length of the head section 14 is 30 mm or shorter, it is possible to improve the operability of the toothbrush 10 in the oral cavity.

The width of the head section 14 (the maximum width of the head section 14 in the Y direction) configured as described above is not particularly limited, and the width is preferably within a range of 7 to 13 mm and, more preferably, within a range of 8 to 12 mm, for example. When the width of the head section 14 is 7 mm or wider, it is possible to sufficiently secure an area of the bristle implanting surface 21-1*b* into which the bristle bundles 12-1 are implanted. In addition, when the width of the head section 14 is 13 mm or narrower, it is possible to improve the operability of the toothbrush 10 in the oral cavity.

Here, with reference to FIG. 2, a position of a boundary between a rear end of the head section 14 and a front end of the neck section 15 and a position of a boundary between a rear end of the neck section 15 and a front end of the handle section 16 are defined. In the present invention, the neck section includes a portion having a width in the Y direction, which is equal to the maximum width of the head section 14 or smaller than the maximum width of the head section 14, between the bristle implanting surface 21-1*b* and the handle section 16.

In the embodiment, in the X direction from a front end of the head section 14 toward a rear end of the handle section 16, the width is reduced in the Y direction, an amount of change in width increases, and then a position at which there is little amount of change in width in the Y direction is set as the position of the boundary between the rear end of the head section 14 and the front end of the neck section 15. In addition, in the X direction from the front end of the neck section 15 toward the rear end of the handle section 16, the width is reduced in the Y direction, an amount of change in width increases, and then a position at which there is little amount of change in width in the Y direction is set as the position of the boundary between the rear end of the neck section 15 and the front end of the handle section 16. In the present invention, a position of a bristle implanting hole on the rear end side of the handle section 16, the bristle implanting hole being disposed at a position most separated from the front end of head section 14 in the X direction from the front end of the head section 14, may be the position of the boundary between the rear end of the head section 14 and the front end of the neck section 15. For example, in a case where it is possible to appropriately set the length of the neck section 15 in the X direction to be within a range of 20 to 70 mm, it is possible to appropriately set a total length of the length of the head section and the length of the neck section to be within a range of 40 to 85 mm, for example.

The neck section 15 is a part that connects the head section 14 and the handle section 16. In addition, the neck section 15 has a deforming portion 15A that is deformed, while stress characteristics associated with bending due to an external force acting on the head section 14 are in a plane stress condition. The neck section 15 is configured to have a width in the Y direction which is narrower than the width of the head section 14 and the handle section 16. For example, the thickness of the neck section 15 in the Z direction can be equal to the thickness of the head section 14.

The neck section 15 has the core portion 25, which is a configurational element of the hard member 17, and the soft portion 26. The core portion 25 is provided with a first part 25-1 that is extended in the X direction (extending direction of the neck section 15) and penetrates the neck section 15 and a second part 25-2 that is extended in the X direction, has one end which is integrated with the first part 25-1, and is disposed in a part of the handle section 16. Here, the first part 25-1 that configures the neck section 15 is described, and the second part 25-2 is described when a configuration of the handle section 16 is described.

Figure 8:
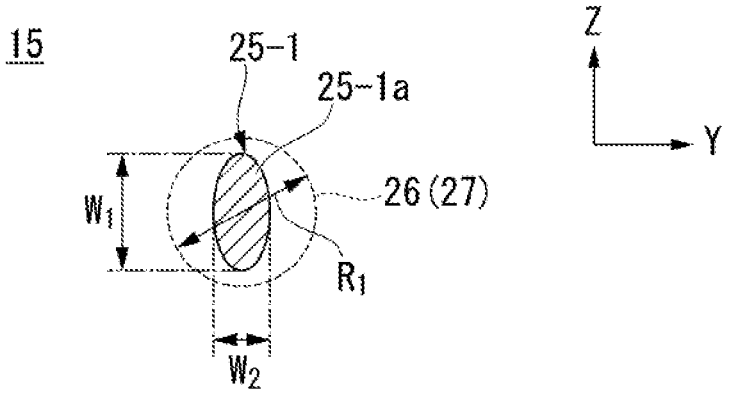
FIG. 8 is a sectional view in a line B-B direction of the hard member shown in FIG. 4.

FIG. 8 is a sectional view in a line B-B direction of the hard member shown in FIG. 4. As shown in FIG. 8, the first part 25-1 is configured to have a front end that is integrated with a rear end of the base member 21 and a rear end that is integrated with the second part 25-2. The first part 25-1 is configured of the hard resin described above. The first part 25-1 is extended with the same size in the X direction.

When a strong external force is applied to the front end of the head section 14, the neck section 15 is formed to be folded (in other words, to avoid a force that is applied to the front end of the head section 14) in the deforming portion 15A (for example, in the vicinity of a central portion of the neck section 15) shown in FIG. 2.

Specifically, when an external force in the X-axis direction (direct-axial load) is applied to the front end of the head section 14, for example, the core portion 25 in the deforming portion 15A is provided with the first part 25-1 that is formed to have a size or a shape so as to be bent within an XY plane. The core portion 25 in the deforming portion 15A shown in FIG. 8 has a sectional shape of substantial ellipse (oval) of which a long diameter direction is a Z-axis direction, and a short diameter direction is a Y-axis direction. The core portion 25 in the deforming portion 15A has the maximum thickness in the Y-axis direction which is thinner than the maximum thickness in the Z-axis direction and second moment of area associated with the bending in the Y-axis direction, which is smaller than second moment of area associated with the bending in the Z-axis direction. Hence, bending in the Y-axis direction (bending within the XY plane) occurs when the direct-axial load is applied.

Figure 9:
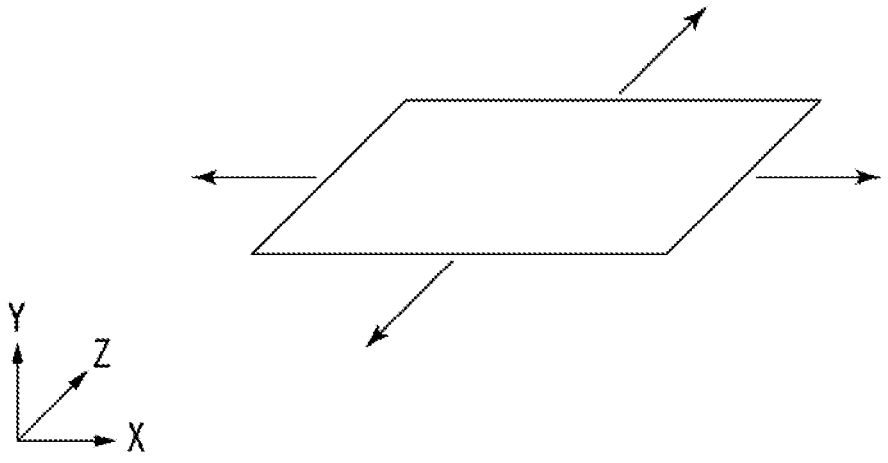
FIG. 9 is a diagram showing a concept of a plane stress condition.

The core portion 25 is formed of the hard resin; however, the core portion has a small thickness in the Y-axis direction, and thereby the deforming portion 15A can be considered to be deformed, while stress characteristics associated with the bending due to the external force acting on the head section 14 are in the plane stress condition in which a stress component ($\sigma y$) associated with the Y-axis direction without an external force acting on the Y-axis direction perpendicular to an XZ plane is zero. As shown in FIG. 9, the plane stress condition is a stress condition approximate to that of a surface facing the Y direction in a thin flat plate (for example, a film-like plate) of which the thickness is negligible.

In a structure exhibiting the stress condition, no force is applied in the Y direction, and thus assumption of the following equation (1) is established in accordance with generalized Hooke's law in the deforming portion 15A.

$$\sigma y=\tau xy=\tau yz=0 \quad (1)$$

In order to cause the deforming portion to be deformed, with the plane stress condition being exhibited, a thickness W2 of the core portion 25 in the deforming portion 15A in the Y-axis direction is preferably 0.5 mm or thicker and 2.0 mm or thinner. When the thickness W2 of the core portion 25 in the deforming portion 15A in the Y-axis direction is thinner than 0.5 mm, it is difficult to insert the head section 14 into the oral cavity and to guide the head section to a desired tooth surface. In addition, when the thickness W2 of the core portion 25 in the deforming portion 15A in the Y-axis direction is thicker than 2.0 mm, the plane stress condition is not exhibited, and there is a possibility that stress-whitening or breaking will occur by the bending due to the external force acting on the head section 14 will occur. The thickness W2 of the core portion 25 in the deforming portion 15A in the Y-axis direction is 0.5 mm or thicker and 2.0 mm or thinner, and thereby it is possible to achieve both the operability during insertion of the toothbrush into the oral cavity and the securing of the plane stress condition of the deforming portion 15A.

In addition, when D represents the thickness in the deforming portion 15A (in a case where the deforming portion 15A has a substantially elliptical shape shown in FIG. 8, D=W2), and L represents a longest sectional length in a section of the deforming portion 15A in a cross section orthogonal to the length direction of the handle section 16 (in a case where the deforming portion 15A has the substantially elliptical shape shown in FIG. 8, L=W1), the following equation (2) may be satisfied in order for the deforming portion 15A to exhibit the plane stress condition.

$$D\times\sqrt{2}\leq L \quad (2)$$

Figure 10:
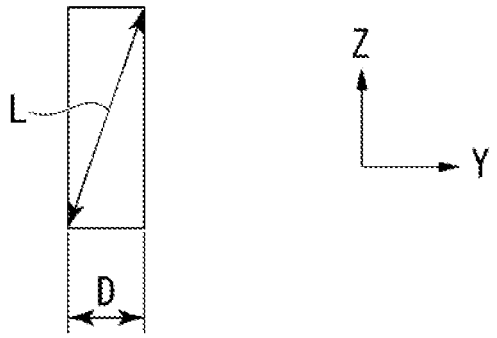
FIG. 10 is a diagram showing a longest sectional length L in a case where a section has a rectangular shape.

For example, as shown in FIG. 10, in a case where the cross section of the deforming portion 15A is a rectangular shape, the longest sectional length L is not a length of a long side but a length of a diagonal.

In order for the plane stress condition to be exhibited, it is preferable to satisfy $D\times\sqrt{2}\leq L$, and more preferable to satisfy $D\times\sqrt{5}\leq L$.

In a case where the length of the deforming portion 15A is short, the strength against the bending is high, and thus the plane stress condition is not exhibited. Hence, it is preferable that the deforming portion 15A has a length of 3 mm or longer. In this manner, when the force is applied to the head section 14, as shown in FIG. 5, the deforming portion 15A exhibiting the plane stress condition is assumed to be a region between a terminal base portion 15X2 and a central portion 15M between a front end base portion 15X1 and the terminal base portion 15X2 in the neck section 15.

In addition, in order to cause the deforming portion to be deformed, with the plane stress condition being exhibited, the second moment of area that is obtained by a mathematical expression which is defined depending on the sectional shape of the core portion, in association with the Y-axis direction of the core portion 25 in the deforming portion 15A is preferably 0.05 to 5.8 $mm^4$ and, particularly preferably 0.05 to 3.5 $mm^4$. When the second moment of area of the core portion 25 in association with the Y-axis direction is less than 0.05 $mm^4$, it is difficult to insert the head section 14 into the oral cavity and to guide the head section to a desired tooth surface. In addition, when the second moment of area of the core portion 25 in the Y-axis direction is larger than 5.8 $mm^4$, the plane stress condition is not exhibited, and there is a possibility that stress-whitening or breaking will occur by the bending due to the external force acting on the head section 14. The second moment of area of the core portion 25 in the deforming portion 15A in association with the Y-axis direction is 0.05 to 5.8 $mm^4$, and thereby it is possible to achieve both the operability during the insertion of the head section into the oral cavity and the securing of the plane stress condition of the deforming portion 15A.

From the viewpoint of steady pressing of the front end of the brush section 12 against teeth, an interdental space, or the like when the teeth are brushed, the thickness W1 of the core portion 25 in the deforming portion 15A in the Z-axis direction is larger than the thickness W2 in the Y-axis direction and is, preferably, 1.5 mm to 4.5 mm and, particularly preferably, 3.5 mm to 4.5 mm.

In this manner, the thickness W1 in the Z direction in the deforming portion 15A is thicker than the thickness W2 in the Y direction, and thereby it is possible to perform folding in the Y direction in the deforming portion 15A when a strong external force or a weak external force is applied to the front end of the head section 14, without degrading cleaning performance of the toothbrush 10. Consequently, since it is possible to avoid the force that is applied to the front end of the head section 14, it is possible to inhibit damage of the oral cavity of the user of the toothbrush 10.

In particular, in a case where the user of the toothbrush 10 is a one- to three-year-old infant, the infant runs, in some cases, in a state in which the toothbrush 10 is put in the mouth as is. In this case, it is possible to inhibit damage of the oral cavity of the infant even when the infant falls.

The soft portion 26 accommodates the first part 25-1 inside and is configured of a second soft resin 27 that is softer than the hard resin that configures the core portion 25. The soft portion 26 is a member that inhibits the first part 25-1 from being exposed and a member for causing the deforming portion 15A of the neck section 15 to be folded when a strong force is applied to the front end of the head section 14. For example, as the second soft resin 27, it is possible to use a soft resin of which a hardness of JIS K 6253 Shore A is 90 or lower. As the soft resin, it is possible to use the soft resin, exemplary examples of which is provided when the first soft resin 22 is described.

The second soft resin 27 may be configured of a type of soft resin different from the first soft resin 22, depending on a purpose. In this case, for example, the hardness of the soft resin that is used as the first soft resin 22 may be higher than the hardness of the soft resin that is used as the second soft resin 27. In such a configuration, it is possible to make the hardness of the front end of the head section 14 different from the hardness of the neck section 15. In addition, the same types of soft resin may be used as the first and second soft resins 22 and 27. Consequently, it is possible to reduce the number of types of soft resins that are used when the toothbrush 10 is manufactured.

Back to FIGS. 5 and 6, the handle section 16 is provided with the second part 25-2 (part of the core portion 25) that configures the core portion 25, a plurality of projecting portions 29 that configure the hard member 17, the handle section main body 31, and ring-shaped recessed portions 32-1 and 32-2. The second part 25-2 is configured of the hard resin, and one end of the second part is integrated with the first part 25-1. The hard resin that configures the second part 25-2 can be the same as the hard resin that configures the first part 25-1, for example.

The second part 25-2 is configured to have a similar shape from the one end of the second part 25-2 toward the plurality of column-shaped projecting portions 29 in the X direction, the similar shape having a sectional shape orthogonal to the X direction continuously increasing in diameter. In other words, in the configuration, a diameter of a part of the second part 25-2, in which the plurality of projecting portions 29 are provided, increases most. In addition, a part of the second part 25-2, which is disposed on the rear end side of the handle section 16 from the plurality of projecting portions 29, has a similar shape from the plurality of projecting portions 29 toward the rear end side of the handle section 16, the similar shape with a sectional shape orthogonal to the X direction continuously decreasing in diameter.

In this manner, of the second part 25-2, the shape of the part disposed on the rear end side of the handle section 16 from the plurality of projecting portions 29 is the shape decreasing in diameter from the plurality of projecting portions 29 toward the rear end side of the handle section 16. Consequently, for example, in a case where the same soft resin is used as the first and second soft resins 22 and 27, as shown in FIG. 12 to be described below, the soft resin moves (flows) easily in the direction (X direction) toward the front end of the head section 14 when the hard member 17 is disposed in the second die 51, and then the soft resin is introduced from the rear end side of the second die 51 into the second die 51. Hence, it is possible to enclose the entire hard member 17 (however, except for the bristle implanting surface 21-1*b* and the plurality of bristle implanting holes 21-1B) with the soft resin with high accuracy. In addition, as will be described below, when the soft resin is introduced into the second die 51, it is possible to inhibit a position and a posture of the hard member 17 from changing in the second die 51 due to the introduced soft resin.

The handle section main body 31 is a part of the toothbrush 10, which the user grips by hand, and is configured of the second soft resin 27. In this manner, the handle section main body 31 is configured of the second soft resin 27, and thereby it is possible to deform (specifically, bend) the handle section main body 31 when the strong external force is applied from the rear end of the toothbrush 10 toward the front end of the head section 14 in a state in which the toothbrush 10 is put in the mouth. Consequently, not only the neck section 15 but also the handle section main body 31 is bent, and thereby it is possible to avoid an external force from the rear end of the toothbrush 10 toward the front end of the head section 14 in a direction different from the direction thereof. Hence, it is possible to inhibit damage of the oral cavity of the user of the toothbrush 10. In addition, the handle section main body 31 is configured of using the second soft resin 27. In this manner, even in a case where the strong force is applied to the handle section main body 31, it is possible to inhibit the handle section 16 from being broken (in other words, the handle section 16 from being folded).

The brush section 12 is configured to have the bristle bundles 12-1 implanted into the plurality of bristle implanting holes 21-1B provided in the base member 21. The bristle bundle 12-1 is a bundle of a plurality of bristles. A length (bristle length) of the bristle bundle 12-1 with the bristle implanting surface 21-1*b* as a reference can be determined with consideration for a bristle bending portion or the like that is necessary for the bristle bundle 12-1. Specifically, the length (bristle length) of the bristle bundle 12-1 can be appropriately set to be within a range of 6 to 13 mm, for example.

For example, the bristle bundle 12-1 may be configured of the plurality of bristles of which the bristle length is adjusted to be equal to each other, or may be configured of the plurality of bristles having different bristle lengths from each other. FIG. 1 shows, as an example of the brush section 12 that configures the toothbrush 10, an example in which front ends of the plurality of bristle bundles 12-1 that configure the brush section 12 are adjusted; however, the present invention is not limited thereto. For example, the plurality of bristle bundles 12-1 that configure the brush section 12 have different lengths from each other, and thereby a step may be provided in the brush section 12.

Figure 11:
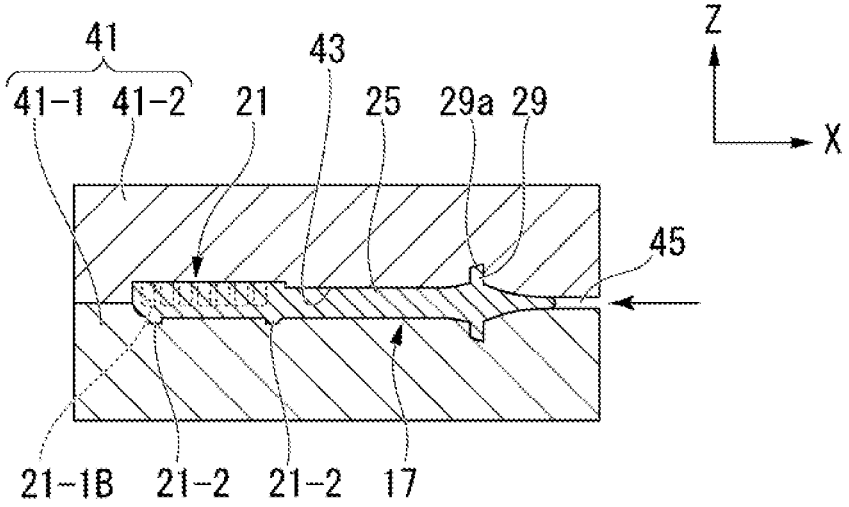
FIG. 11 is a sectional view showing a step of manufacturing the toothbrush of the embodiment and shows a view showing a step of forming the hard member by using a first die.

FIG. 11 is a sectional view showing a step of manufacturing the toothbrush of the embodiment and shows a view showing a step of forming the hard member by using the first die. FIG. 12 is a sectional view showing a step of manufacturing the toothbrush of the embodiment and shows a view showing a step of forming the first soft resin, the soft portion, and the handle section main body by using the second die. In addition, an arrow in FIG. 11 indicates a direction in which the hard resin is introduced, and an arrow in FIG. 12 indicates a direction in which the soft resin (soft resin N to be described below) is introduced.

In the step shown in FIG. 11, the first die 41 provided with a space 43, which is made by a pair of dies 41-1 and 41-2 and corresponds to a shape of the hard member 17 inside, and an introduction port 45 for introducing the hard resin into the space 43 is prepared. The die 41-2 is provided with projecting portions (not shown) for forming the plurality of bristle implanting holes 21-1B. In addition, the introduction port 45 is disposed on the rear end side of the space 43. Subsequently, the space 43 is filled with a melted hard resin (resin having the flexural modulus (JIS 7171) that is within a range of 500 to 3,000 MPa) which is a base material of the hard member 17 via the introduction port 45, and the hard resin is hardened. In this manner, the hard member 17 is formed, in which the base member 21 including the plurality of bristle implanting holes 21-1B and the support portions 21-2, the core portion 25, and the plurality of projecting portions 29 are integrated with each other. Then, the hard member 17 is released from the first die 41.

Subsequently, in the step shown in FIG. 12, the second die 51 provided with a space 53, which is made by a pair of dies 51-1 and 51-2 and corresponds to a shape of the toothbrush 10 except for the brush section 12 shown in FIG. 1, and an introduction port 55 for introducing the hard resin into the space 53 is prepared. For example, a joining surface of the pair of dies 51-1 and 51-2 is set at an intermediate position of the soft portion 26 (handle section main body 31) in the Z direction. The die 51-2 is provided with projecting portions (not shown) for forming the plurality of bristle implanting holes 21-1B. In addition, the introduction port 55 is disposed on the rear end side of the space 53.

Subsequently, the hard member 17 is disposed in a front end portion of the space 53 of the second die 51. In this case, the inner surface of the die 51-2 and the bristle implanting surface 21-1*b* are brought into contact with each other such that the plurality of bristle implanting holes 21-1B are covered, and end surfaces of the two support portions 21-2 and the inner surface of the die 51-1 are brought into contact with each other. Further, projecting surfaces 29*a* of the plurality of (in a case of the embodiment, four) projecting portions 29 and the inner surface of the second die 51 are brought into contact with each other.

Subsequently, the space 53 is filled with the melted soft resin N (resin of which the hardness of JIS K 7215 Shore A is 90 or lower) via the introduction port 55. Then, the soft resin N is hardened, and thereby the first soft resin 22, the soft portion 26, and the handle section main body 31 are formed. Consequently, the handle body 11 having the head section 14, the neck section 15, and the handle section 16 is formed. Then, the handle body 11 is released from the inside of the second die 51.

According to the toothbrush of the embodiment includes the deforming portion 15A that is deformed, while stress characteristics associated with the bending due to the external force acting on the head section 14 are in the plane stress condition. Hence, when the strong external force is applied in the direction from the rear end of the toothbrush 10 toward the front end of the head section 14 in a state in which the user puts the toothbrush 10 in the mouth, the deforming portion 15A is easily deformed (specifically, is folded), thereby, it is possible to avoid the force that is transmitted to the front end of the head section 14, and it is possible to cause the first soft resin 22 that is soft and is disposed on the front end of the head section 14 to be brought into contact with the inside of the oral cavity of the user. Hence, it is possible to inhibit damage of the oral cavity of the user of the toothbrush 10.

In particular, in a case where the user of the toothbrush 10 is a one- to three-year-old infant, the infant runs, in some cases, in a state in which the toothbrush 10 is put in the mouth as is. In this case, it is possible to inhibit damage of the oral cavity of the infant even when the infant falls.

Evaluation of Plane Stress Condition of Deforming Portion 15A

A test for checking the plane stress condition of the deforming portion 15A in the toothbrush was conducted by using a sample. The sample was prepared with respect to three kinds of homogeneous PP having different melt flow rates (MFR) from each other. The sample was prepared by injection molding into a rectangular parallelepiped shape having a different thickness, in accordance with specifications described in Table 1 for each grade.

Evaluation Method

Figure 13:
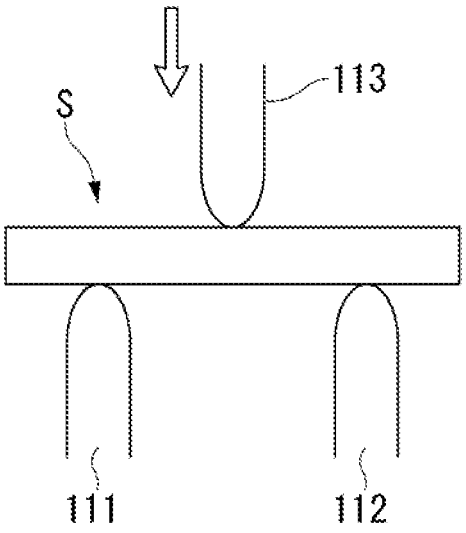
FIG. 13 is a view showing a bending strength test conducted on a sample.
Figure 14:
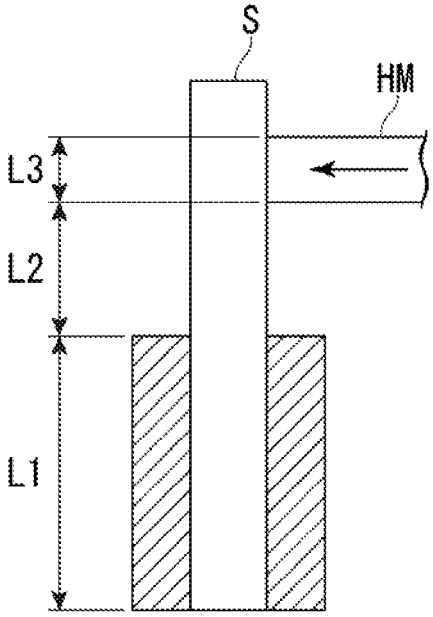
FIG. 14 is a view showing an IZOD impact strength test conducted on a sample.

A bending strength test and an IZOD impact strength test were conducted on the samples in accordance with the specifications described in Table 2. As shown in FIG. 13, in the bending strength test, in a state in which a sample S was supported from below by supports 111 and 112 disposed at positions having an inter-supporting point distance of 64 mm, a central portion between the supports 111 and 112 was pressed from below by a pusher 113 having a diameter of 5 mm by a compression distance of 30 mm with a change in speed. As shown in FIG. 14, in the IZOD impact strength test, the sample S was chucked at a distance L1 (L1=50 mm) from a lower end of the sample, and a load was applied by a hammer HM having a width L3 (L3=15 mm) at a position separated from a chuck portion by a distance L2 (L2=20 mm).

The samples were evaluated on the basis of presence or absence of the breaking or stress-whitening which occurred by the test. The test was conducted three times (n=3).

The evaluation of the sample was performed after the conductions of the tests, in which ◎ (double circle mark) represents a case where breaking and stress-whitening are not observed, Δ (triangle mark) represents a case where breaking does not occur and only stress-whitening is observed, and x (cross mark) represents a case where breaking occurs.

TABLE 1

| Sample | A | B | C | D | E | F | G | H |
|---|---|---|---|---|---|---|---|---|
| Thickness D (mm) | 0.5 | 1.0 | 2.0 | 3.0 | 5.0 | 0.5 | 1.0 | 2.0 |
| Width (mm) | | | 5.0 | | | | 5.0 | |
| Second moment of area ($mm^4$) | 0.05 | 0.4 | 3.3 | 11.3 | 52.1 | 0.05 | 0.4 | 3.3 |
| Longest sectional length L (mm) | 5.0 | 5.1 | 5.4 | 5.8 | 7.1 | 5.0 | 5.1 | 5.4 |
| Length (mm) | | | 100 | | | | 100 | |
| MFR(g/10 min) | | | 8 | | | | 15 | |
| Bending modulus (MPa) | — | 863 | 1380 | 1370 | 1370 | — | 894 | 1412 |

| Sample | I | J | K | L | M | N | O |
|---|---|---|---|---|---|---|---|
| Thickness D (mm) | 3.0 | 5.0 | 0.5 | 1.0 | 2.0 | 3.0 | 5.0 |
| Width (mm) | | | | | 5.0 | | |
| Second moment of area ($mm^4$) | 11.3 | 52.1 | 0.05 | 0.4 | 3.3 | 11.3 | 52.1 |
| Longest sectional length L (mm) | 5.8 | 7.1 | 5.0 | 5.1 | 5.4 | 5.8 | 7.1 |
| Length (mm) | 100 | | | | 100 | | |
| MFR(g/10 min) | 15 | | | | 45 | | |
| Bending modulus (MPa) | 1397 | 1406 | — | 1081 | 1576 | 1574 | 1571 |

TABLE 2

| Evaluation test | Bending strength test | IZOD impact strength test |
|---|---|---|
| Test condition | Test speed (mm/min); 2,100, 500 | Energy (J); 1.0, 2.75, 5.5 |
| Common test condition | Inter-supporting point distance: diameter (mm) of 64 mm indenter; compression distance of 5 mm; 30 mm | hammer lifting angle; 150° |
| Calculation method | $\sigma = 3F \max L/2bh^2$ | — |
| Apparatus | Autograph tester AGS-H (SHIMADZU) | IZOD impact tester DG-1B (TOYOSEIKI) |
| Standard | Refer to JIS K7171 | Refer to JIS K7110 |

As shown in Table 3 to be described below, in a case where the sample had a thickness of 3 mm or thinner after the bending strength test, the stress-whitening was observed, and it was possible to verify that the stress characteristics associated with the bending in the deforming portion 15A did not exhibit the plane stress condition. By contrast, when the sample had a thickness of 2 mm or thinner (the second moment of area is 3.3 mm4 or smaller) after the bending strength test, the stress-whitening and the breaking did not occur, and thus it was possible to verify that the deforming portion 15A was deformed, while the stress characteristics associated with the bending are in the plane stress condition. In addition, regarding the flexural modulus, a measurement result was not obtained in the sample having the thickness of 0.5 mm; however, the resin having the flexural modulus within the range of 500 to 3,000 MPa was used, and thereby it is possible to achieve both the operability during the insertion of the toothbrush into the oral cavity and the securing of the plane stress condition of the deforming portion 15A.

TABLE 3

[Evaluation after Bending Strength Test]

| | Sample | | | | | | | | | | | | | | |
|---|---|---|---|---|---|---|---|---|---|---|---|---|---|---|---|
| | A | B | C | D | E | F | G | H | I | J | K | L | M | N | O |
| | Thickness (mm) | | | | | | | | | | | | | | |
| | 0.5 | 1.0 | 2.0 | 3.0 | 5.0 | 0.5 | 1.0 | 2.0 | 3.0 | 5.0 | 0.5 | 1.0 | 2.0 | 3.0 | 5.0 |
| 2 mm/min | ◎ | ◎ | ◎ | Δ | Δ | ◎ | ◎ | ◎ | Δ | Δ | ◎ | ◎ | ◎ | Δ | Δ |
| 100 mm/min | ◎ | ◎ | ◎ | Δ | Δ | ◎ | ◎ | ◎ | Δ | Δ | ◎ | ◎ | ◎ | Δ | Δ |
| 500 mm/min | ◎ | ◎ | ◎ | Δ | Δ | ◎ | ◎ | ◎ | Δ | Δ | ◎ | ◎ | ◎ | Δ | Δ |

Similarly, as shown in Table 4 to be described above, in a case where the sample had the thickness of 5 mm or thicker after the IZOD impact strength test, the breaking occurred. In a case where the sample had the thickness of 3 mm or thicker, the stress-whitening was observed, and thus it was possible to verify that the deforming portion 15A does not exhibit the stress characteristics associated with the bending are in the plane stress condition. By contrast, when the sample had the thickness of 2 mm or thinner (the second moment of area is 3.3 mm4 or smaller) after the IZOD impact strength test, the stress-whitening and the breaking did not occur, and thus it was possible to verify that the deforming portion 15A was deformed, while the stress characteristics associated with the bending are in the plane stress condition.

TABLE 4

[Evaluation after IZOD Impact Strength Test]

| | Sample | | | | | | | | | | | | | | |
|---|---|---|---|---|---|---|---|---|---|---|---|---|---|---|---|
| | A | B | C | D | E | F | G | H | I | J | K | L | M | N | O |
| | Thickness (mm) | | | | | | | | | | | | | | |
| | 0.5 | 1.0 | 2.0 | 3.0 | 5.0 | 0.5 | 1.0 | 2.0 | 3.0 | 5.0 | 0.5 | 1.0 | 2.0 | 3.0 | 5.0 |
| 1.0 J | ◎ | ◎ | ◎ | Δ | Δ | ◎ | ◎ | ◎ | Δ | Δ | ◎ | ◎ | ◎ | Δ | X |
| 2.75 J | ◎ | ◎ | ◎ | Δ | Δ | ◎ | ◎ | ◎ | Δ | Δ | ◎ | ◎ | ◎ | Δ | X |
| 5.5 J | ◎ | ◎ | ◎ | Δ | Δ | ◎ | ◎ | ◎ | Δ | Δ | ◎ | ◎ | ◎ | Δ | X |

As described above, the preferred embodiment of the present invention is described with reference to the accompanying drawings; however, it is needless to say that the present invention is not limited to the example. The shape, the combination, or the like of the configurational members described in the above examples is an example, and it is possible to perform various types of modification based on a design requirement or the like within a range without departing from the gist of the present invention.

For example, in the embodiment, the configuration in which the deforming portion 15A is provided in the neck section 15 is an exemplary example; however, the embodiment is not limited to the configuration, and a configuration in which the handle section 16 has the stress characteristics associated with the bending due to the external force acting on the head section 14, the stress characteristics being in the plane stress condition, or a configuration in which both the neck section 15 and the handle section 16 exhibit the plane stress condition may be employed.

In addition, the embodiment employs the configuration in which the soft portion accommodates at least a part of the hard member; however, a configuration may be employed, in which the deforming portion 15A is configured of only the hard member because the breaking and the stress-whitening do not occur in a case where the stress characteristics associated with the bending are in the plane stress condition in the deforming portion 15A. Further, the bending strength is secured, in which it is possible to steadily press the front end of the brush section 12 against the teeth, the interdental space, or the like, and thereby the deforming portion (entire toothbrush) can be configured of only the soft resin.

INDUSTRIAL APPLICABILITY

The present invention can be applied to a toothbrush and a method for manufacturing the toothbrush.

REFERENCE SIGNS LIST

10: toothbrush
14: head section
15: neck section
15A: deforming portion
16: handle section
17: hard member
21-1*b*: bristle implanting surface

What is claimed:

1. A toothbrush comprising:

a head section that has a bristle implanting surface on a front end side;

a handle section that is disposed on a rear end side from the head section;

a neck section that is disposed between the bristle implanting surface and the handle section; and wherein the neck section is located on the rear end side from the bristle implanting surface and has a deforming portion that is deformed, by an external force in a longitudinal direction of the handle section acting on the head section, by bending in a direction parallel with the bristle implanting surface and orthogonal to the longitudinal direction of the handle section while exhibiting a plane stress condition in the deforming portion, wherein the deforming portion includes a core portion that is formed of a hard resin and a soft portion that is formed of a soft resin, a region where the deforming portion is deformed is covered with the soft resin over the entire length direction, wherein the core portion has second moment of area of 0.05 $mm^4$ or larger and 5.8 $mm^4$ or smaller in the bending direction due to the external force.

2. The toothbrush according to claim 1, wherein a thickness of the core portion in a direction orthogonal to the bristle implanting surface is 70% or more and 90 or less of the thickness of the deformed portion.

3. The toothbrush according to claim 1, wherein the hard resin is Polypropylene.

4. The toothbrush according to claim 1, further comprising:

a hard member that is disposed over a region from the head section to at least a part of the handle section on the front end side, includes the core portion and is formed of the hard resin, wherein the hard member does not occur stress-whitening and breaking by the following evaluation method A, evaluation method A:

in a state in which the hard member was supported from below by supports disposed at positions having an inter-supporting point distance of 64 mm, a central portion between the supports was pressed from below by a pusher having a diameter of 5 mm by a compression distance of 30 mm with a change in speed, if the thickness and width of the hard member are different, press toward the thinner cross section, the speed is divided into 2 mm/min, 100 mm/min, and 500 mm/min for testing.

5. The toothbrush according to claim 4, wherein the hard member does not occur stress-whitening and breaking by the following evaluation method B, evaluation method B:

the hard member was chucked at distance of 50 mm from a lower end of the hard member, and according to JIS K7110, a load was applied by a hammer having width of 15 mm at a position 20 mm above a chuck portion, if the thickness and width of the hard member are different, the load was applied toward the thinner cross section.

6. The toothbrush according to claim 1, a hard member that is disposed over a region from the head section to at least a part of the handle section on the front end side, includes the core portion and is formed of the hard resin, the rear end side of the hard member is not in contact with the other hard resin.

7. The toothbrush according to claim 6, the hard portion includes a plurality of projecting portions that are provided at intervals in the circumferential direction, and are exposed from the handle section.

8. The toothbrush according to claim 1, a hard member that is disposed over a region from the head section to at least a part of the handle section on the front end side, includes the core portion and is formed of the hard resin, wherein when D represents the thickness of the hard member in the deforming portion in the bending direction, and L represents a longest sectional length in a section of the hard member in the deforming portion, the section being orthogonal to a length direction of the handle section, a relationship of $D \times \sqrt{5} \leq L$ is satisfied.

9. A method for manufacturing a toothbrush, comprising:

a step of designing a toothbrush including a head section that has a bristle implanting surface on a front end side, a handle section that is disposed on a rear end side from the head section, and a neck section that is disposed between the bristle implanting surface and the handle section; and a step of molding the designed toothbrush, wherein designing the toothbrush includes designing that the neck section is located on the rear end side from the bristle implanting surface, and has a deforming portion that is deformed, by an external force in a longitudinal direction of the handle section acting on the head section, by bending in a direction parallel with the bristle implanting surface and orthogonal to the longitudinal direction of the handle section while exhibiting a plane stress condition in the deforming portion, wherein the deforming portion includes a core portion that is formed of a hard resin and a soft portion that is formed of a soft resin, a region where the deforming portion is deformed is covered with the soft resin over the entire length direction, wherein the core portion has second moment of area of 0.05 $mm^4$ or larger and 5.8 $mm^4$ or smaller in the bending direction due to the external force.

* * * * *